US008794545B2

(12) United States Patent
Johnson et al.

(10) Patent No.: US 8,794,545 B2
(45) **Date of Patent: *Aug. 5, 2014**

(54) INTERNAL BAFFLING FOR FUEL INJECTOR

(75) Inventors: Thomas Edward Johnson, Greer, SC (US); Benjamin Lacy, Greer, SC (US); Christian Stevenson, Greenville, SC (US)

(73) Assignee: General Electric Company, Schenectady, NY (US)

( * ) Notice: Subject to any disclaimer, the term of this patent is extended or adjusted under 35 U.S.C. 154(b) by 387 days.

This patent is subject to a terminal disclaimer.

(21) Appl. No.: 12/567,022

(22) Filed: Sep. 25, 2009

(65) Prior Publication Data

US 2011/0073684 A1 Mar. 31, 2011

(51) Int. Cl.
*F23D 11/10* (2006.01)

(52) U.S. Cl.
USPC ..... 239/423; 239/426; 239/431; 239/434; 239/499; 239/504

(58) Field of Classification Search
CPC ..... F23D 11/10; B05B 1/28; B05B 1/265
USPC ..... 239/419, 421, 423–424.5, 426, 427, 239/427.3, 499, 429–431, 433, 434, 504
See application file for complete search history.

(56) References Cited

U.S. PATENT DOCUMENTS

| | | | | |
|---|---|---|---|---|
| 233,397 | A * | 10/1880 | Bradley | 239/417 |
| 3,701,479 | A * | 10/1972 | Leslie et al. | 239/407 |
| 4,100,733 | A | 7/1978 | Striebel et al. | |
| 4,966,001 | A | 10/1990 | Beebe | |
| 5,170,942 | A | 12/1992 | Spink et al. | |
| 5,263,325 | A | 11/1993 | McVey et al. | |
| 5,603,213 | A * | 2/1997 | Sion et al. | 60/258 |
| 5,904,477 | A | 5/1999 | Van Dam et al. | |
| 6,267,585 | B1 | 7/2001 | Suttrop | |
| 7,007,478 | B2 | 3/2006 | Dinu | |
| 8,112,999 | B2 | 2/2012 | Zuo | |
| 8,147,121 | B2 | 4/2012 | Lacy et al. | |
| 8,157,189 | B2 | 4/2012 | Johnson et al. | |
| 8,181,891 | B2 * | 5/2012 | Ziminsky et al. | 239/430 |
| 2005/0097883 | A1 | 5/2005 | Ryu et al. | |
| 2010/0031662 | A1 | 2/2010 | Zuo | |
| 2010/0186413 | A1 | 7/2010 | Lacy et al. | |
| 2010/0252652 | A1 | 10/2010 | Johnson et al. | |

FOREIGN PATENT DOCUMENTS

| | | |
|---|---|---|
| EP | 0 017 407 A2 | 10/1980 |
| EP | 0 845 592 B1 | 8/2003 |

* cited by examiner

*Primary Examiner* — Christopher Kim
(74) *Attorney, Agent, or Firm* — Nixon & Vanderhye P.C.

(57) ABSTRACT

A fuel injector includes a fuel delivery tube; a plurality of pre-mixing tubes, each pre-mixing tube comprising at least one fuel injection hole; an upstream tube support plate that supports upstream ends of the plurality of pre-mixing tubes; a downstream tube support plate that supports downstream ends of the plurality of pre-mixing tubes; an outer wall connecting the upstream tube support plate and the downstream tube support plate and defining a plenum therewith; and a baffle provided in the plenum. The baffle includes a radial portion. A fuel delivered in the upstream direction by the fuel delivery tube is directed radially outwardly in the plenum between the radial portion of the baffle and the downstream tube support plate, then in the downstream direction around an outer edge portion of the radial portion, and then radially inwardly between the radial portion and the upstream tube support plate.

11 Claims, 2 Drawing Sheets

INTERNAL BAFFLING FOR FUEL INJECTOR

STATEMENT REGARDING FEDERALLY SPONSORED RESEARCH OR DEVELOPMENT

This invention was made with Government support under Contract No. DE-FC26-05NT42643 awarded by the Department of Energy. The Government has certain rights in this invention.

FIELD OF THE INVENTION

The present invention relates to a fuel injector, and more particularly to a fuel injector including internal baffling.

BACKGROUND OF THE INVENTION

Fuel nozzles may be designed to pre-mix natural gas fuel. Fuel nozzles may also be designed to burn a hydrogen fuel which is much more reactive and hence has a much higher flame speed. The term pre-mixed combustion refers to fuel nozzles for combustion systems in which the air and fuel are introduced upstream of where the combustion process takes place. One approach to designing nozzles that burn high reactivity fuels is to do this premixing in very many small tubes for reasons such as increased quenching and to insure minimal recirculation zones behind the fuel jets. To build such an injector in a practical mechanical package it is desirable to introduce the fuel from a single tube in the center of the injector. However, when this is done without regard to the internal flows of the gasses, the result is a very high velocity past the first mixing tubes seen by the gas and very low velocities at the outermost mixing tubes. This results in a substantial total pressure gradient within the nozzle, which is very undesirable for achieving a uniform amount of gas being injected into each mixing tube. In addition to the unacceptable pressure field the resulting very low velocities at the points furthest away from the feed tube produce very low cooling effectiveness, which can result in high metal temperatures and thus low part life.

BRIEF DESCRIPTION OF THE INVENTION

According to a sample embodiment, a fuel injector comprises a fuel delivery tube; a plurality of pre-mixing tubes, each pre-mixing tube comprising at least one fuel injection hole; an upstream tube support plate that supports upstream ends of the plurality of pre-mixing tubes; a downstream tube support plate that supports downstream ends of the plurality of pre-mixing tubes; an outer wall connecting the upstream tube support plate and the downstream tube support plate and defining a plenum therewith; and a baffle provided in the plenum. The baffle comprises a radial portion. A fuel delivered in the upstream direction by the fuel delivery tube is directed radially outwardly in the plenum between the radial portion of the baffle and the downstream tube support plate, then in the downstream direction around an outer edge portion of the radial portion, and then radially inwardly between the radial portion and the upstream tube support plate.

According to another sample embodiment, a method of pre-mixing fuel and air in a fuel injector is provided. The fuel injector comprises a plurality of pre-mixing tubes, each having at least one fuel injection hole, provided in a plenum having an upstream side and a downstream side. The method comprises delivering a fuel flow to a center of the upstream side of the plenum; directing the fuel flow toward a radially outer portion of the plenum; turning the fuel flow in a direction opposite the delivery direction; and directing the fuel flow toward a radially inner portion of the plenum to feed the fuel into the fuel injection holes to be mixed with an air flow provided to the pre-mixing tubes.

DETAILED DESCRIPTION OF THE INVENTION

Figure 1:
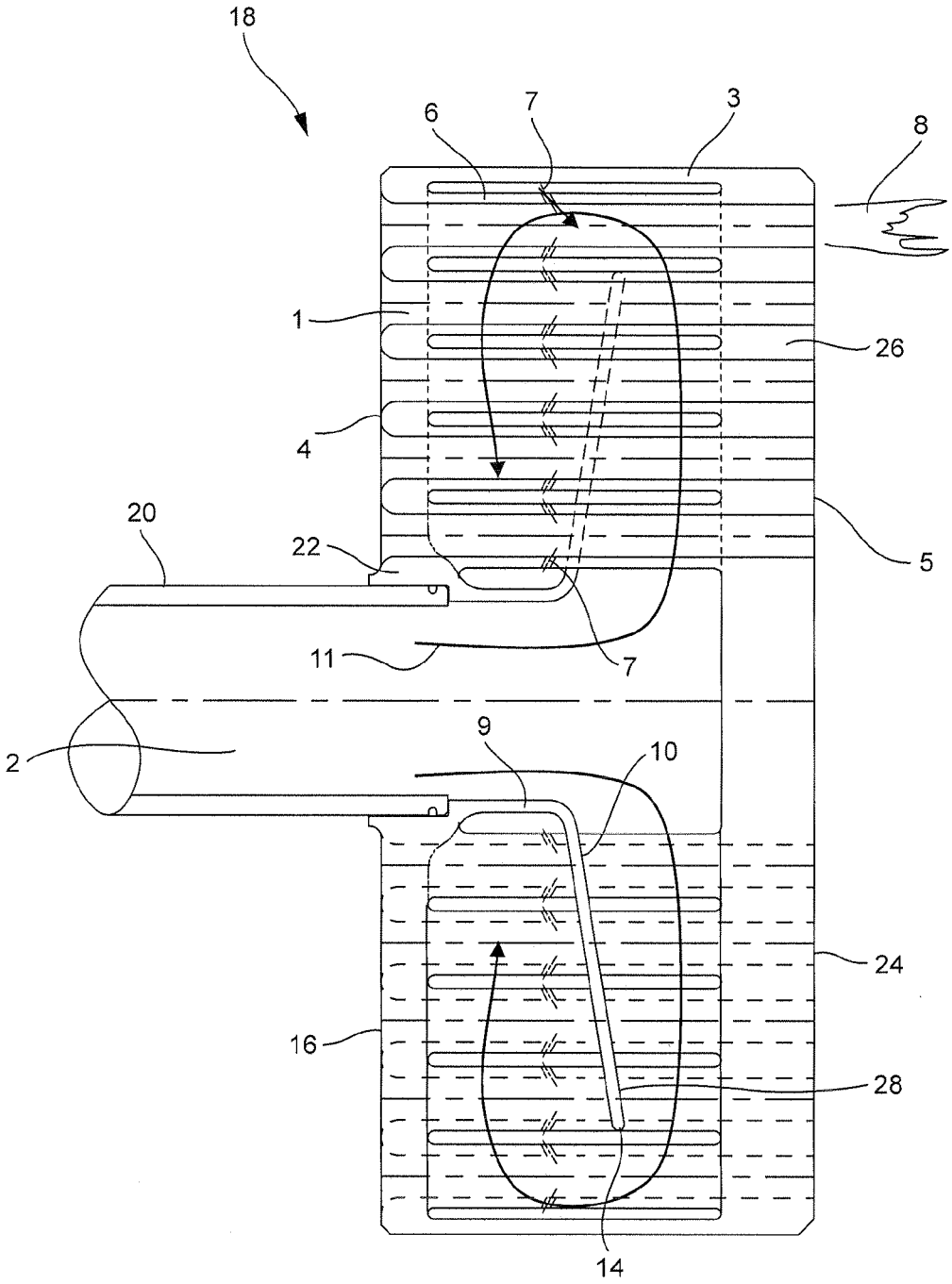
FIG. 1 is a sectional view of a fuel injector according to one sample embodiment.
Figure 2:
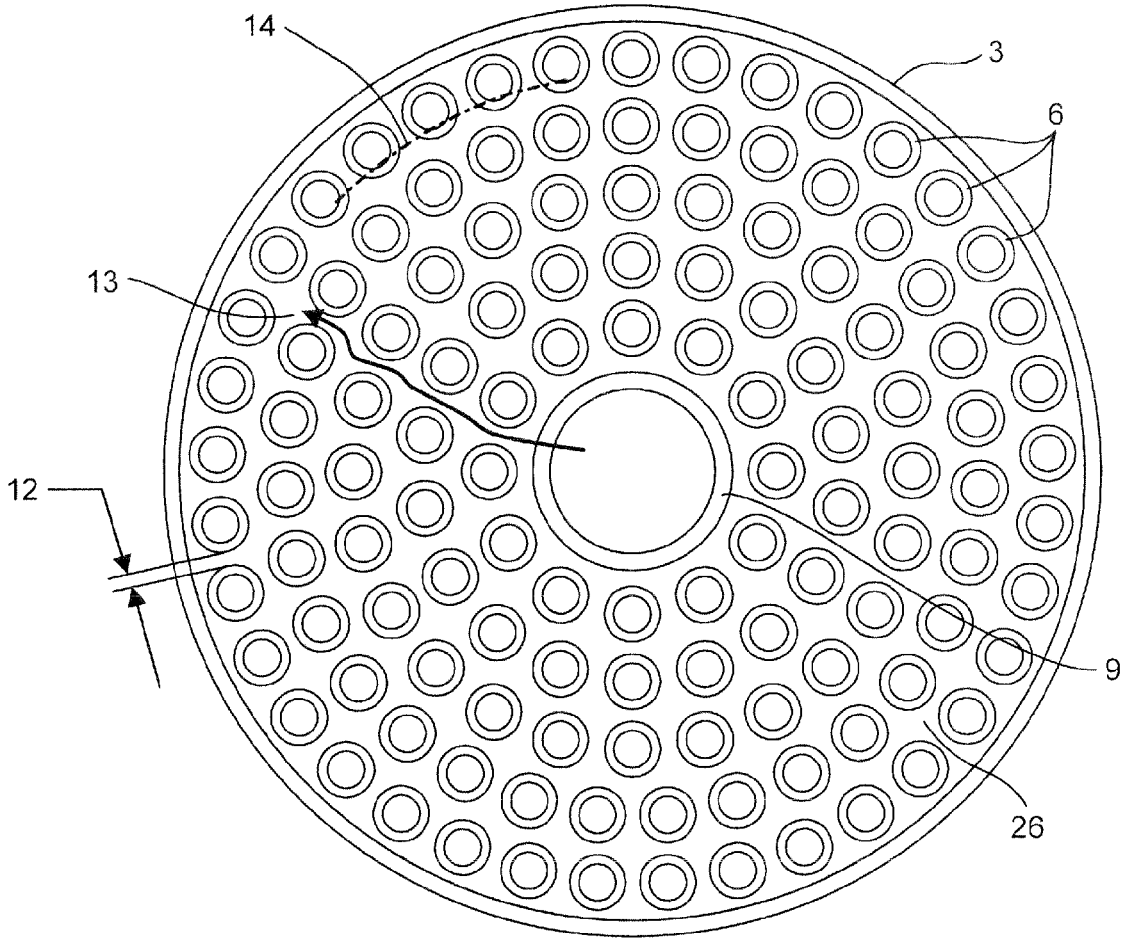
FIG. 2 is a front view of an internal portion of the fuel nozzle with the radial baffle removed.

Referring to FIGS. 1 and 2, a fuel injector 18 comprises a fuel delivery tube 20 and a plurality of pre-mixing tubes 6. The pre-mixing tubes 6 are supported by a first, upstream tube support plate 16 at an upstream face or side 4 of the fuel injector and a second, downstream tube support plate 24 at a downstream face or side 5 of the fuel injector 18. An outer wall 3 connects the tube support plates 16, 24. A plenum 26 is formed by the outer wall 3 and the tube support plates 16, 24. The pre-mixing tubes 6 are supported by the first, upstream tube support plate 16 and the second, downstream tube support plate 24.

An internal baffle 22 is supported at the end of the fuel delivery tube 20. The internal baffle 22 includes a cylindrical portion 9 that is supported by the fuel delivery tube 20 and a radial portion 10 that extends radially into the plenum 26.

A fuel 2 enters the plenum 26 of the fuel injector 18 from the fuel delivery tube 20 connected to the first, upstream tube support plate 16 and is channeled through the cylindrical portion 9 of the internal baffle 22 where the fuel flow 11 stagnates on the backside of the aft face 28. The fuel flow 11 is then accelerated radially outward traveling between the backside of the aft face 28 of the radial portion 10 of the internal baffle 22 and the second, downstream support plate 24. At the same time the gas flow 11 travels between the outside surfaces of the pre-mixing tubes 6. The innermost row of pre-mixing tubes 6 has the most restrictive area as the cross sectional area is smallest at this radial dimension.

All of the pre-mixing tubes 6 are placed approximately equidistant from one another to gain the highest amount of flow area per total face area. As the fuel flow 11 travels a radially outward path 13 it has more tube-to-tube gaps 12 to flow through. This results in a lower velocity and a higher feed pressure. When the fuel flow 11 reaches the radially outermost portion of the nozzle it turns around the outer edge 14 of the radial portion 10 of the internal baffle 22 and flows in an aft direction and then radially inward between the first, upstream tube support plate 16 and the radial portion 10 of the internal baffle 22. The fuel flow 11 is then exposed to the fuel injection holes 7 where it starts to flow into the pre-mixing tubes 6 where it mixes with an air flow 1.

At the radially outward position the fuel is flowing at a slower velocity because of the large area. This low velocity results in a high pressure feeding the pre-mixing tubes 6. As the fuel migrates radially inward the area decreases, however the flow velocity does not increase because some of the flow has exited the plenum 26 via the fuel injection holes 7. This continues for each row resulting in the desirable uniform gas feed rate into each pre-mixing tube 6. The pre-mixed fuel and air is combusted in a flame region 8 of a combustor. This routing of the gas flow 11 ensures that the radially outermost portion of the fuel injector 18 does not experience stagnating fuel, which would result in a low heat transfer coefficient. In addition to providing a high degree of cooling, the baffle 22 helps achieve a more uniform distribution of pressures within the fuel injector 18. This results in a consistent feed pressure across each fuel injection hole 7 and thus results in a predictable fuel air ratio within the pre-mixing tubes 6.

It should be appreciated that the shape and location of the baffle may be otherwise than as shown. For example, if the fuel injector is square or pie shaped, as opposed to round, the baffle would take on this shape. Additionally, vent holes could be employed within the baffle to help achieve a uniform pressure/velocity. The cylindrical and/or radial baffle portions may also have conical shapes to achieve uniform flow parameters.

It should also be appreciated that other methods may also be employed to keep the fuel injector cool. For example, the fuel injector may also include thermal barrier coatings or external heat shields that may rely on cooling air from a nearby source.

Two concerns with multi-tube fuel nozzles burning hydrogen or other highly reactive fuels are addressed. The fuel injector provides a high rate of uniform cooling to increase part life in environments burning hydrogen or other highly reactive fuels and it provides a uniform feed to the pre-mixing tubes, which improves operability and emissions compliance. Higher flame speeds of more reactive gases require aggressive cooling schemes, which the fuel injector addresses in a simple yet robust design.

The fuel injector controls velocities and pressures of the fuel at the same time. The fuel injector also provides sufficient cooling without the need for TBC or outside cooling air to be introduced. The fuel injector also uses a single center fuel feed design by solving the pressure distribution problem in a compact, low cost design. The design is flexible in that it can be incorporated into various shapes and sizes, for example by retrofitting, which is useful for scaling of designs.

The fuel injector may be employed in any gas turbine fuel nozzle where multi-tube designs for very reactive fuels are employed. The fuel injector may also be used in other burners, such as furnaces, where hydrogen or other reactive fuels are now being used.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel injector, comprising:

a fuel delivery tube;

a plurality of pre-mixing tubes, each pre-mixing tube comprising at least one fuel injection hole;

an upstream tube support plate that supports upstream ends of the plurality of pre-mixing tubes;

a downstream tube support plate that supports downstream ends of the plurality of pre-mixing tubes;

an outer wall connecting the upstream tube support plate and the downstream tube support plate and defining a plenum therewith; and a baffle provided in the plenum, the baffle comprising a radial portion extending into the plenum, with an outer edge spaced from the outer wall thereby creating a radial gap between the outer edge of the baffle and the outer wall, an area upstream of the baffle establishing a fuel feeding area between the baffle and the upstream tube support plate.

2. A fuel injector according to claim 1, wherein the baffle comprises at least a cylindrical or conical portion connected to the fuel delivery tube.

3. A fuel injector according to claim 1, wherein the plurality of pre-mixing tubes are placed approximately equidistantly from each other.

4. A fuel injector according to claim 1, wherein the upstream and downstream tube support plates are circular.

5. A fuel injector according to claim 4, wherein the radial portion of the baffle is circular.

6. A fuel injector according to claim 1, wherein the radial portion of the baffle comprises a conical shape.

7. A fuel injector according to claim 1, wherein the at least one fuel injection hole comprises at least one through hole extending from an outer radial portion to an inner radial portion of the pre-mixing tube and slanted from upstream to downstream.

8. A fuel injector according to claim 7, wherein the at least one fuel injection hole comprises two fuel injection holes, each fuel injection hole being slanted from upstream to downstream.

9. A fuel injector according to claim 1, wherein the shape of the radial portion of the baffle is such as to control velocity to improve cooling along the downstream tube support plate and the plurality of pre-mixing tubes to provide thermal protection.

10. A fuel injection head for a fuel nozzle comprising: an upstream support plate, a downstream support plate and an outer wall extending therebetween, forming a plenum; a fuel feed tube extending through the upstream support plate into the plenum; an internal baffle plate extending substantially radially outwardly from the fuel feed tube and terminating short of said outer wall, thereby defining upstream and downstream portions of said plenum in fluid communication by way of a radial gap between said baffle plate and said outer wall; and a plurality of pre-mix tubes extending axially through said upstream and downstream portions of said plenum and through said internal baffle plate, with at least one fuel injection hole extending between each of said pre-mix tubes and said upstream portion of the plenum, thereby enabling fuel in said upstream portion of the plenum to be injected into said plurality of pre-mix tubes.

11. The fuel injection head of claim 10 wherein said internal baffle plate is angled in a radially outward direction toward said downstream support plate.

* * * * *